United States Patent [19]

Wang

[11] Patent Number: 4,824,120

[45] Date of Patent: Apr. 25, 1989

[54] TOY GUN TARGET BOARD CAPABLE OF COLLECTING SOFT PROJECTILES

[76] Inventor: Hsieh Y. Wang, 22296 S. De Anza Cir., Cupertino, Calif. 95014

[21] Appl. No.: 143,726

[22] Filed: Jan. 14, 1988

[51] Int. Cl.[4] ..... F41J 3/00

[52] U.S. Cl. ..... 273/347; 273/394

[58] Field of Search ..... 273/347, 346, 394

[56] References Cited

U.S. PATENT DOCUMENTS

| | | | |
|---|---|---|---|
| 2,092,162 | 9/1937 | Hiatt | 273/347 |
| 3,790,173 | 2/1974 | Callaway | 273/371 |
| 3,942,798 | 3/1976 | Koski | 273/394 |
| 4,291,885 | 9/1981 | Cohen | 273/347 |

FOREIGN PATENT DOCUMENTS

| | | | |
|---|---|---|---|
| 2702502 | 7/1978 | Fed. Rep. of Germany | 273/347 |

*Primary Examiner*—Paul E. Shapiro

*Attorney, Agent, or Firm*—Varndell Legal Group

[57] ABSTRACT

A toy gun target board device mainly comprises a box body, a movable plate disposed inside the box body and a spring provided between the movable plate and bottom plate of the box body. A score board with holes equally and properly spaced is disposed on the surface of the box body. The movable plate has extensions to form ejection portions that extend out through openings at the upper part of both sides of the box body. A plurality of sticks corresponding in number and position to the holes on the score board are disposed on the movable plate, and individually extend out through the holes toward the users. A receiving tray is formed at the lower part of the box body for collecting soft projectiles.

4 Claims, 2 Drawing Sheets

TOY GUN TARGET BOARD CAPABLE OF COLLECTING SOFT PROJECTILES

BACKGROUND OF THE INVENTION

This invention relates to a toy gun target board which is capable of easily collecting soft projectiles. The conventional dartboards include a wooden board whose surface is printed with some concentric circles, and/or divided into areas in different sizes sio that scores can be indicated by the areas into which the projectiles are fallen. The dartboards are mostly designed for throwing knives, and are not suitable for receiving the projectiles of toy guns.

It is my idea to design of a target board to accept the projectiles, usually soft balls of toy guns. I generally tried to make dartboards with an adhesive surface to catch the soft balls. It works, nevertheless, a user must later take off the soft balls from boards one by one. In that situation, the quantity of soft balls fired by a toy gun is always much larger than that of the throwing knives during the same time period, the adhesive dart board thus has a shortcoming of being time-consuming for collecting soft projectiles.back. The present invention seeks to provide a toy gun target board which is free of the shortcoming mentioned above.

SUMMARY OF THE INVENTION

The invention includes a box body with a surface score board on which there are fully provided with holes equaly spaced with each other. Beneath the score board, a movable plate is disposed, above which are provided sticks correspondingly positioned with the holes on the score board and extended out the holes therethrough. The spaces defined by the sticks can accept and hold the soft balls therein. The inside movable plate has portions extended out of the box body and formed ejection portions which can be pressed by a user to release all soft projectiles on the score board instantly. A plurality of fixing rods seat between the score board and the bottom plate of the box body, and there are springs surrounding the fixing rods between the movable plate and bottom plate of the box body so that the movable plate may be pressed down by applying a force on the ejection portions. The soft balls held between the sticks will be released and fall into a receiving tray on the lower portion of the box body when the sticks move down, following a movement of the movable plate. Thus, the present invention provides a target board for toy guns which can easily and quickly collect the projectiles without reducing the interests of the users.

DETAILED DESCRIPTION OF THE PREFERRED EMBODIMENT

Figure 1:
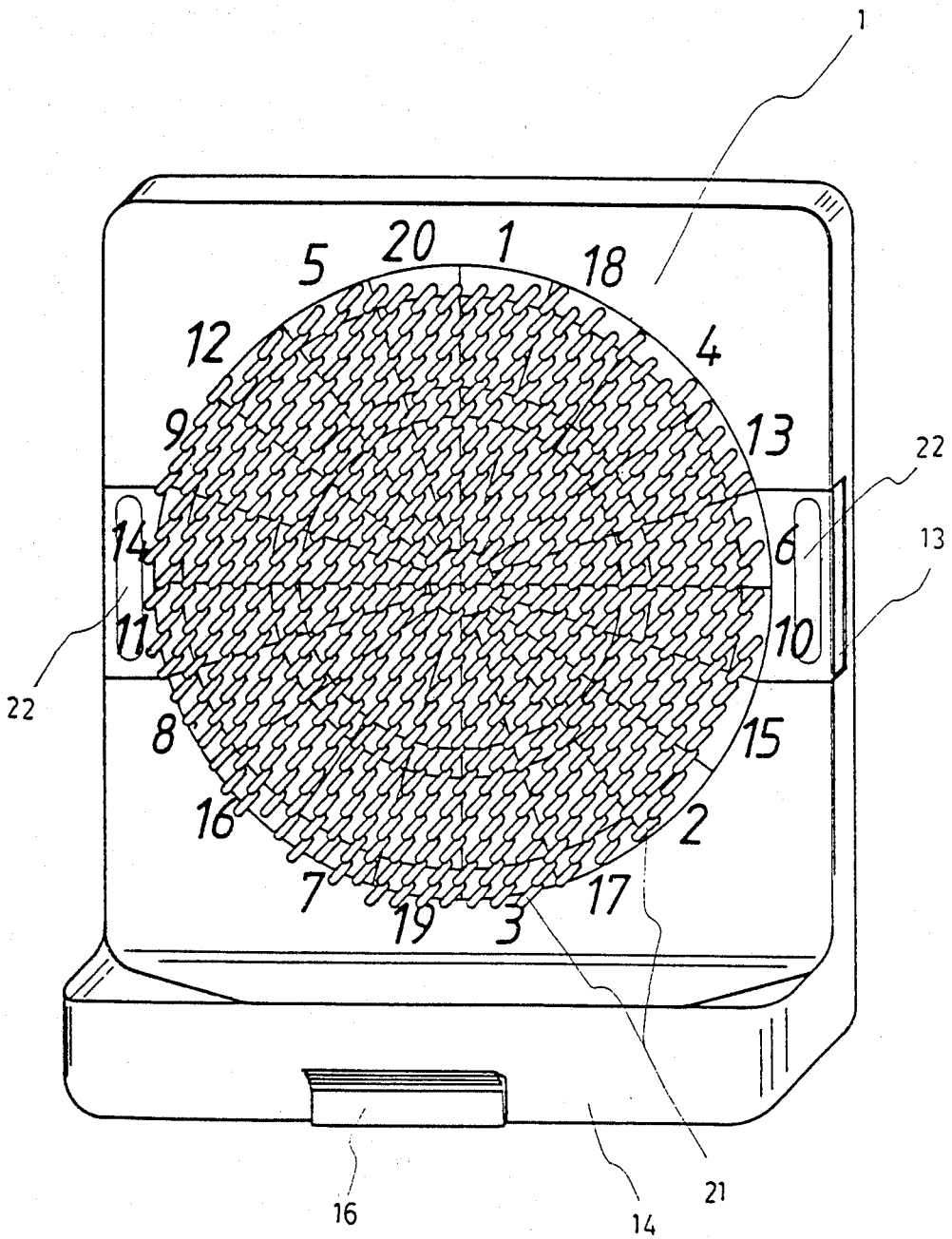
FIG. 1 is a perspective view of the target board device according to the present invention.

Referring now to the drawings:

In a preferred embodiment, the invention includes a box body 1, a movable plate 2 disposed inside the box body and spring means provided between the movable plate and bottom plate of the box body. On the surface of the box body 1 is disposed a score board 10 on which holes equally spaced with each other are provided. The movable plate 2 has extensions of ejection portions 22 on two sides extending out from openings 13 at upper part of the two sides of box body, whereby the ejection portions 22 can make an up and down movement inside the openings. There are fixing rods 12 seated between the score board 10 and the bottom plate 15 of the box body, and the movable plate 2 has holes 23 so as to let the fixing rods 12, spass therethrough. Around the fixing rods 12, springs are provided between the movable plate 2 and the bottom plate 15 so that the movable plate may be pressed down by applying a force on the ejection portions, and automatically return to its original position when the force on the ejection portions is removed.

Above the movable plate 2, there are disposed sticks 21 corresponding in number and position to the holes 11 on the score board 10. The sticks individually extend out through the holes, toward the players. Defined by the sticks, the spaces therebetween can accept and hold the soft balls A therein. At the lower portion of the box body 1, a receiving tray 14 is provided to receive the soft balls A fallen down after the sticks 21 has moved down to a level under the surface of the score board 10. The bottom surface of the receiving tray 14 is further designed to incline from both sides to its center region where a drawer 16 is mounted thereunder, which can receive and collect all the soft balls in the receiving tray 14.

The above mentioned fixing rods 12 not only function as a support for the springs, but also have the ability to guide and limit the movable plate 2 on its movement to ensure a precise movement of the sticks 21 in and out of the holes 11 of the score board 10.

Figure 3:
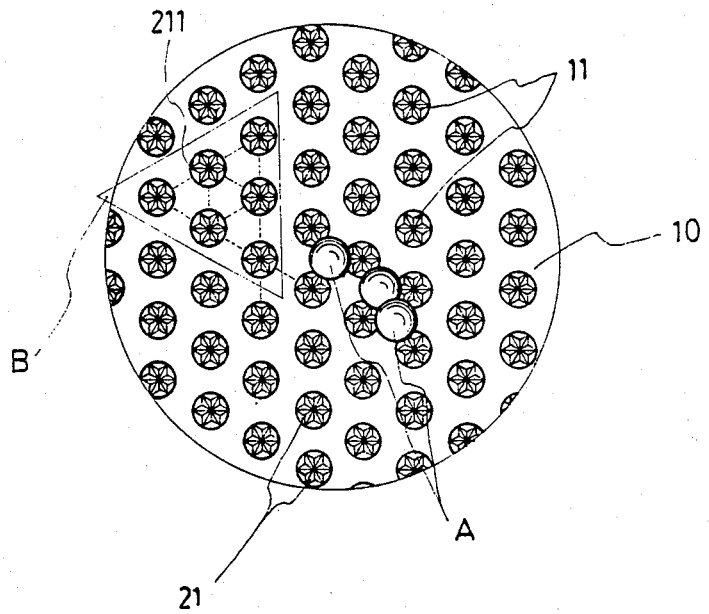
FIG. 3 is a schematical view showing the soft balls held in position by the sticks.
Figure 2:
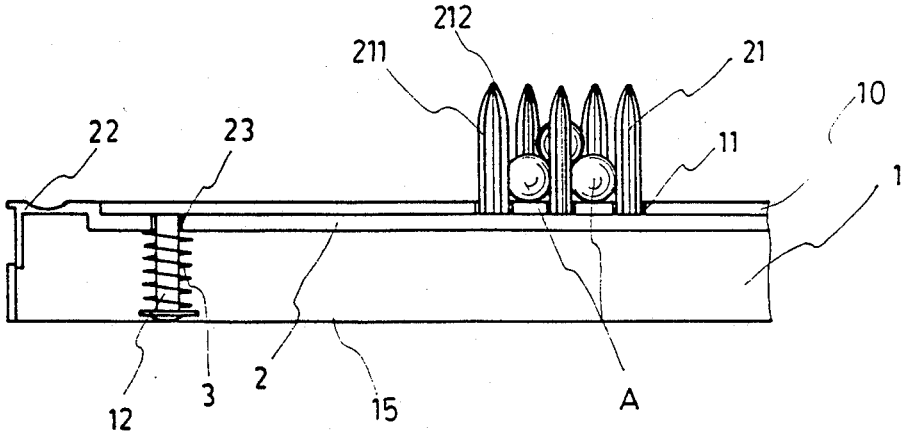
FIG. 2 is a partly vertical sectional view of FIG. 1.

The above mentioned sticks 21 have a generally cylindrical body, with a plurality of symmetrialline flanges 211 formed on the periphery, and converged to a tip point 212. In this arrangement, the flying soft balls will never receive a react force from the sticks 21. It is obvious that the number and direction of the arrangement of the flanges 211 on the sticks, and the basic unit's composition of the sticks have a variety of implementations all of which would not be departing from the spirit of the present invention. FIG. 3 shows an embodiment of this invention: referring to Region B, the sticks are arranged and positioned to form a triangle section and have six symmetrical line flanges 211 so that the space is equally divided by the sticks and suitable for holding the soft balls.

When using the target board device, a flying soft ball projectiles would be stopped by the sticks and held in the space therebetween. To take off and collect the soft balls on the target board, users only need to press the ejection portions 22 down; the movable plate 2 will at the same time make a downward movement, and when the sticks go down below the surface of the target board, the soft balls would fall automatically into the receiving tray and finally roll down into the drawer 16 which can be then pulled out for collecting the soft balls.

I claim:

1. A toy gun target board device mainly comprising a box body, a movable plate disposed inside the box body and spring means provided between the movable plate and bottom plate of the box body; wherein a score board with holes equally and properly spaced is disposed on the surface of the box body; the movable plate has extensions to form ejection portions that extend out through openings at the upper part of both sides of the box body; a plurality of sticks corresponding in number and position to the holes on the score board are disposed on the movable plate, and individually extend out through the holes toward the users; and a receiving tray is formed at the lower part of the box body for collecting soft projectiles.

2. A toy gun target board device according to claim 1, wherein a plurality of fixing rods are provided between the score board and the bottom plate of the box to support spring means seated between the movable plate and the bottom plate of the box body, and pass through the holes on the movable plate to guide the movement thereof.

3. A toy gun target board device according to claim 1, wherein the bottom surface of the receiving tray is inclined from both sides to the center region where a drawer is mounted thereunder for collecting soft projectiles.

4. A toy gun target board device according to claim 1, wherein the sticks are arranged and positioned in units of triangles and are formed with six symmetrical line flanges.

* * * * *